US006368179B1

(12) United States Patent
Kang

(10) Patent No.: US 6,368,179 B1
(45) Date of Patent: Apr. 9, 2002

(54) FALSIE STRUCTURE

(76) Inventor: Hsiang Hsin Kang, 5FL., No. 96-2, Fushan St., Taoyuan City, Taoyuan (TW)

( * ) Notice: Subject to any disclaimer, the term of this patent is extended or adjusted under 35 U.S.C. 154(b) by 0 days.

(21) Appl. No.: 09/562,622

(22) Filed: May 2, 2000

(51) Int. Cl.[7] ..... A41C 3/00
(52) U.S. Cl. ..... 450/38; 450/57; 623/7
(58) Field of Search ..... 450/38, 39, 54–57; 523/7, 8; 2/267

(56) References Cited

U.S. PATENT DOCUMENTS 4,247,351 A * 1/1981 Renchenberg ..... 450/38 X
5,944,578 A * 8/1999 Lin et al. ..... 450/57
5,997,380 A * 12/1999 Yang ..... 450/57
6,099,565 A * 8/2000 Sakura, Jr. ..... 623/8
6,110,006 A * 8/2000 Chen ..... 450/57
6,132,288 A * 10/2000 Aerts ..... 450/38
6,187,043 B1 * 2/2001 Ledergerber ..... 623/8
6,224,458 B1 * 5/2001 Chen ..... 450/57

* cited by examiner

*Primary Examiner*—Gloria M. Hale
(74) *Attorney, Agent, or Firm*—Rosenberg, Klein & Lee

(57) ABSTRACT

The present invention proposes a modified falsie structure, which comprises a container made of waterproof and flexible material. Fluid and a plurality of hollow microspheres are filled in the container. Cloth is joined on the outer surface of the container by glue, heat melting, or sewing. The container and the cloth are of circular arc shape with concave arc edges. The concave arc edges can be bent to get close to form a three-dimensional bust form. The center of the falsie can form a projecting shape and its rigidity can be enhanced so that it will not be easily deformed. Thereby the falsie of the present invention can enhance the appearance of the breasts of the user for a long time when directly placed in the brassiere. Moreover, the breasts of the user can be uniformly pressured to achieve better feeling and comfort.

11 Claims, 10 Drawing Sheets

FALSIE STRUCTURE

FIELD OF THE INVENTION

The present invention relates to an improved falsie structure and, more particularly, to an improved falsie structure which includes a fluid filled bag structure to form a three-dimensional bust form that conforms to the three-dimensional cup of a brassiere and exhibits the natural curvature of a breast. The falsie structure may be placed in the brassiere to enhance the appearance of the breasts for a long time. Moreover, the breasts of the user can be uniformly contacted and supported to provide better feel and comfort.

BACKGROUND OF THE INVENTION

As shown in FIG. 1, a conventional fluid-bag falsie 10*a* used in a brassiere comprises a container 11*a* made of waterproof and flexible material. Fluid (not shown) is filled in the container 11*a* to enhance its firmness. The falsie 10*a* can be placed inside a brassiere cup, or can be sheathed within a brassiere cup. With the fluid in the container 11*a*, both feel and comfort can be enhanced.

However, the container 11*a* used in a conventional falsie 10*a* is made of soft material. When fluid is filled therein, the container 11*a* fails to hold a set form and assumes a flat shape such that it does not correspond to the three-dimensional cup of the brassiere to exhibit the natural curvature of a breast.

Moreover, the waterproof and flexible container 11*a* used in a conventional falsie 10*a* has little firmness so that it easily deforms with the flow of the fluid therein. Therefore, the fluid-bag falsie cannot maintain an ideal shape and must be fastened to the cup when placed in a brassiere. It is generally necessary to sew on the fluid-bag falsie to maintain an ideal appearance and to fasten the fluid-bag falsie at a suitable position.

SUMMARY AND OBJECTS OF THE PRESENT INVENTION

The primary object of the present invention is to provide an improved falsie structure, which can be configured to form a three-dimensional bust form, letting the center of the falsie project to conform to the three-dimensional cup shape of a brassiere and thereby exhibit a more natural curvature of a breast.

Another object of the present invention is to provide a modified falsie structure, wherein a cloth layer is joined to the outer surface of its container to enhance firmness. The fluid-bag falsie thus will not be easily deformed. The drawback that the enhanced appearance of the breasts cannot be maintained over a long period of time when the fluid-bag falsie is directly placed in a brassiere will be overcome. Moreover, discomfort and uneven feel to the user resulting from nonuniform pressure upon the breasts by the falsie can be improved.

Yet another object of the present invention is to provide an improved falsie structure, which can be placed or sheathed in a brassiere cup to achieve the effects of light weight and even feel and comfort.

To accomplish the above objects, the present invention provides an improved falsie structure which comprises a container made of waterproof and flexible material. Fluid and a plurality of hollow microspheres are filled in the container. A cloth layer is joined to the outer surface of the container. The container and cloth layer are generally of circular arc shape with an intermediate concave arc edge portion. The concave arc edge portion can be folded to form a three-dimensional bust form.

BRIEF DESCRIPTION OF THE DRAWINGS

The various objects and advantages of the present invention will be more readily understood from the following detailed description when read in conjunction with the appended drawings, in which.

DETAILED DESCRIPTION OF THE PREFERRED EMBODIMENTS

Figure 1:
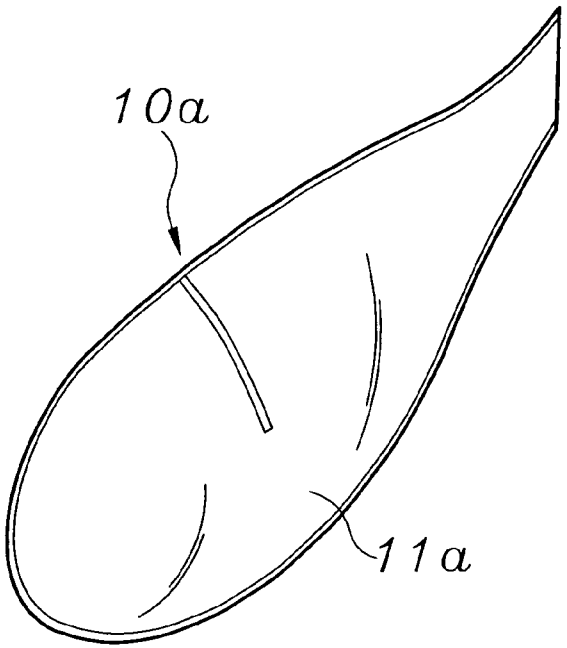
FIG. 1 is a perspective view of a falsie in the prior art.
Figure 2:
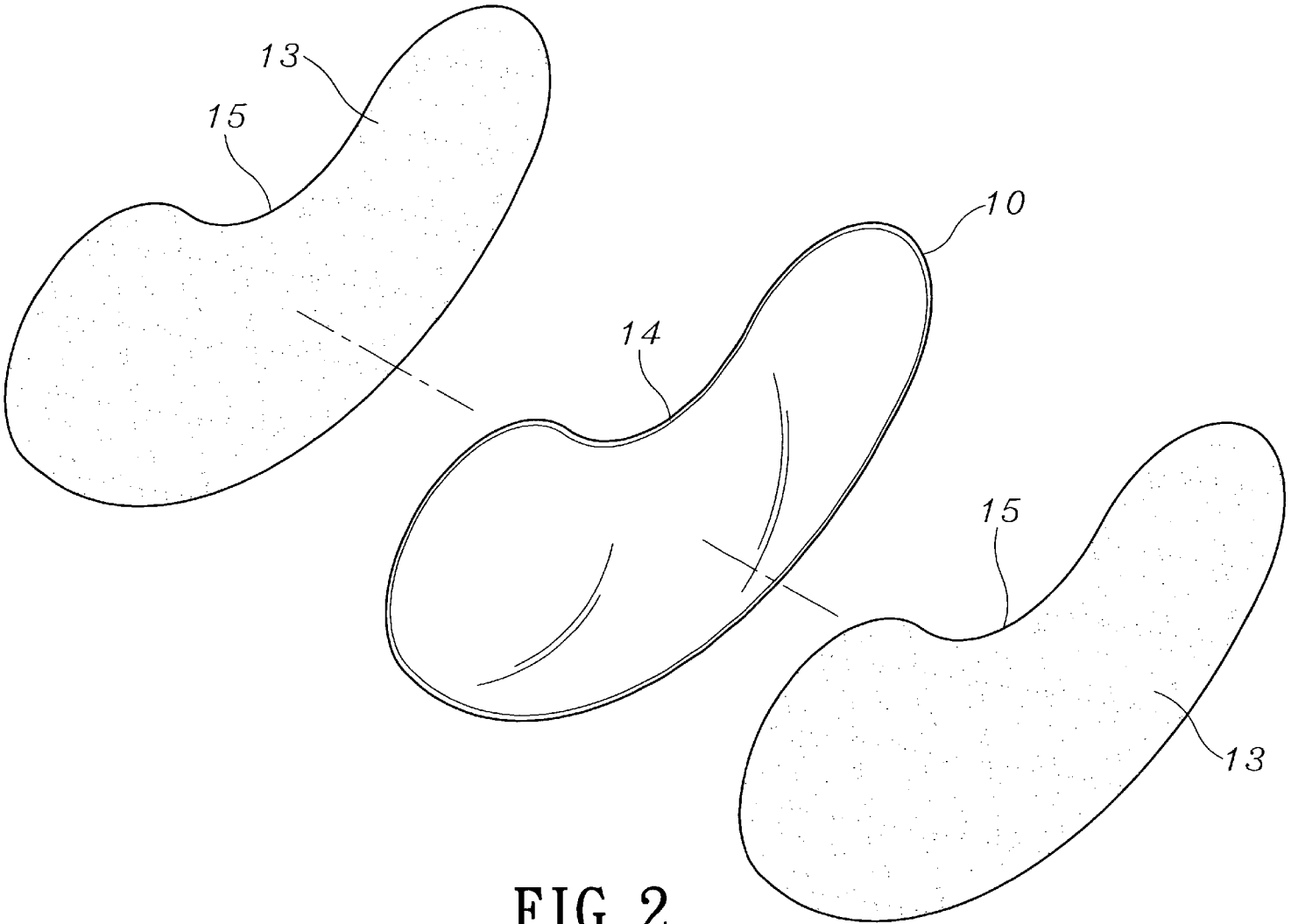
FIG. 2 is an exploded view of a falsie of the present invention.

As shown in FIGS. 2 to 5, an improved falsie structure of the present invention comprises a container 10 made of waterproof and flexible material such as plastic film. The outer contour of the container is of circular arc shape with an intermediate concave arc edge portion 14. A plurality of hollow microspheres 11 and a suitable quantity of fluid 12 are filled in the container 10. The fluid 12 can be oil or water to render the immersed hollow microspheres 12 sufficiently mobile to produce a real and natural feel.

The shape, size, and capacity of the container 10 can be determined according to the size of the brassiere. The density and diameter of each hollow microsphere 11 are about 0.035 and 100~150 $\mu$m, respectively. The ratio of the fluid 12 to microspheres 11 is determined according to the required mobility and weight. The total weight can be greatly reduced with the help of the hollow microspheres 11. The hollow microspheres 11 can also be solid microspheres of smaller density.

The outer surface of the waterproof and flexible container 10 used to envelop the fluid 12 and the hollow microspheres 11 is joined to a cloth layer 13. The cloth layer 13 is of circular arc shape corresponding to that of the container 10 with an intermediate concave arc edge portion 15. The cloth layer 13 can be one of various kinds of cloths and is joined to the outer surface of the container 10. For instance, the cloth layer 13 can be petrochemical cloth to be joined on the outer surface of the container by heat melting. Or the cloth layer 13 can be cotton or hemp cloth to be sewn on the outer surface of the container 10. Two sheets of cloth layers 13 are respectively fixed on opposing outer sides of the container 10 in the preferred embodiment of the present invention.

Figure 3:
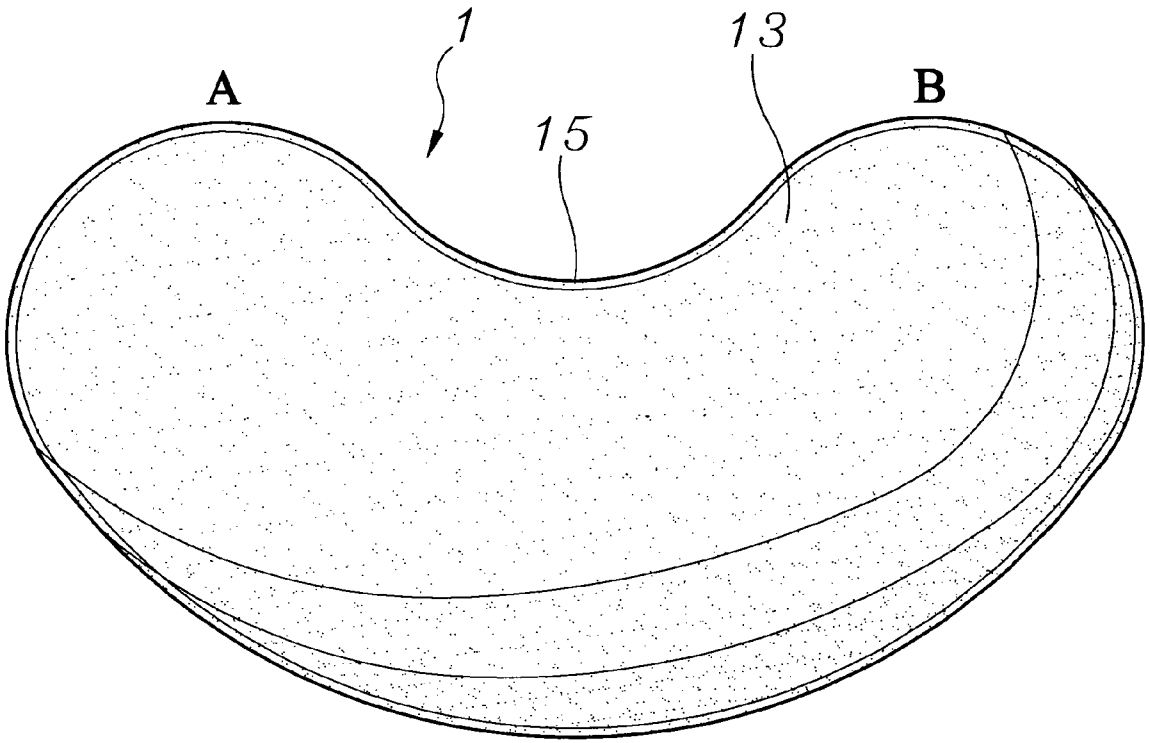
FIG. 3 is a perspective view of a falsie of the present invention.
Figure 4:
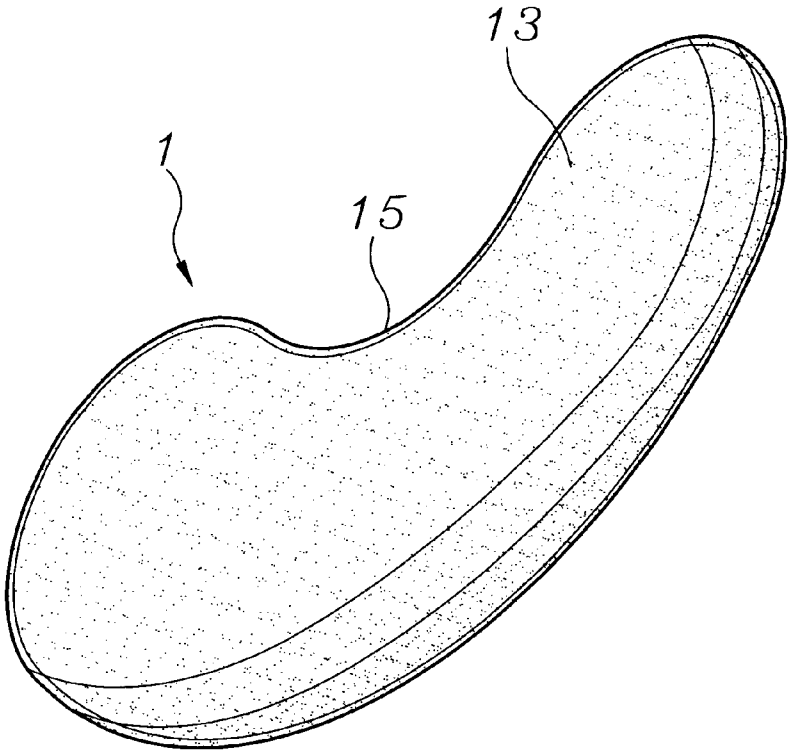
FIG. 4 is a front view of a falsie of the present invention.
Figure 5:
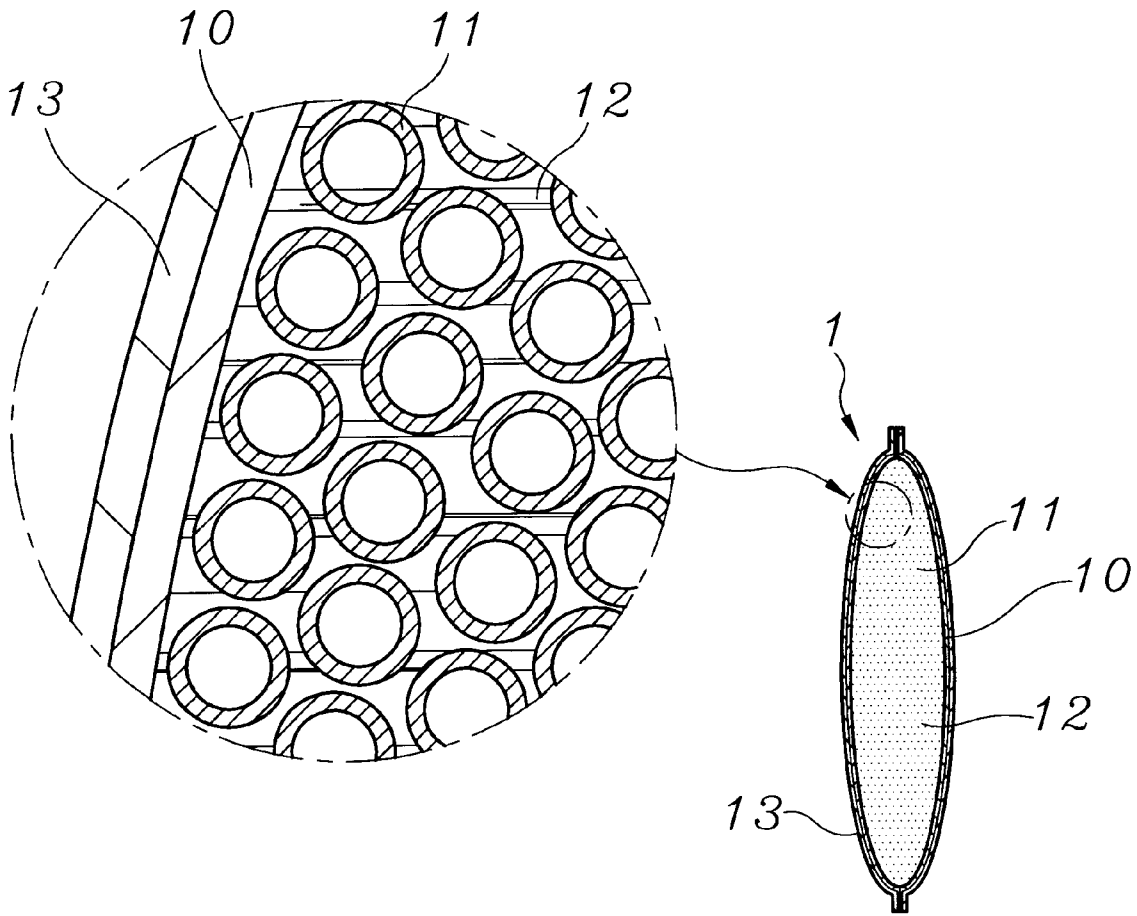
FIG. 5 is a cross-sectional view of a falsie of the present invention.
Figure 6:
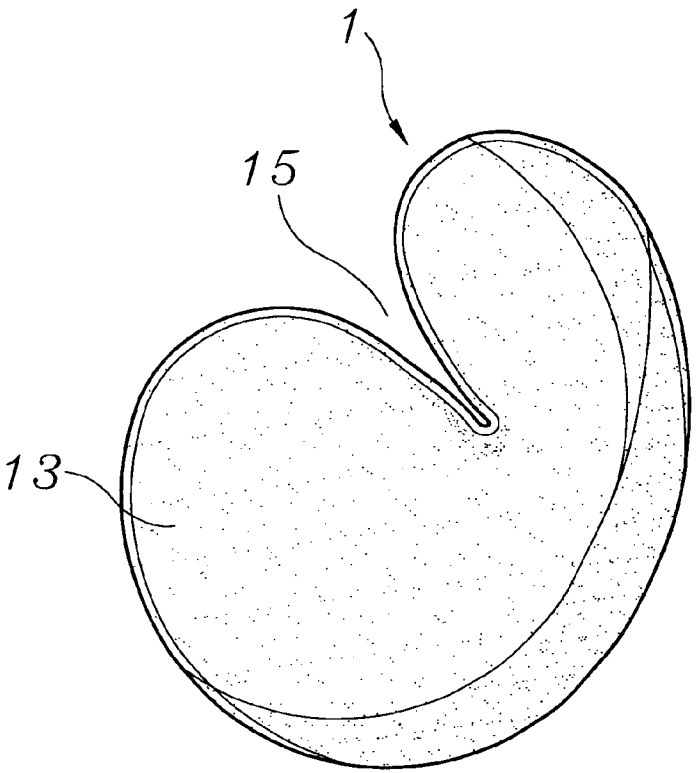
FIG. 6 is a perspective view of a falsie of the present invention when assembled.
Figure 8:
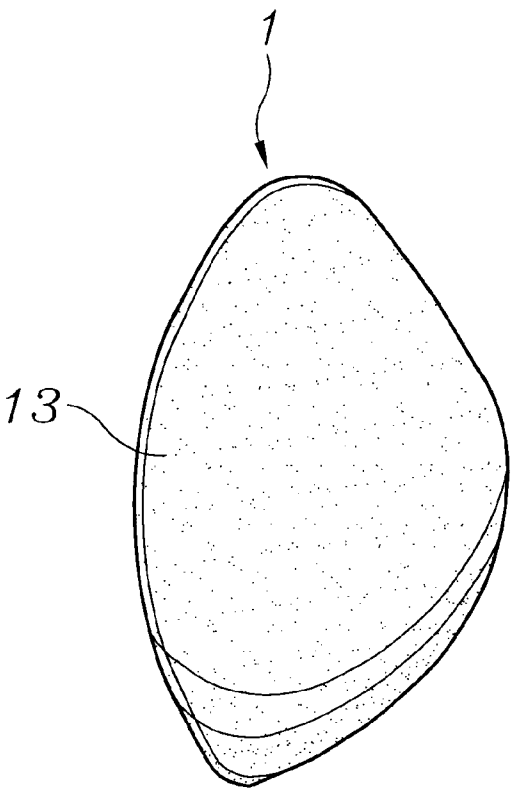
FIG. 8 is a side view of a falsie of the present invention when assembled.
Figure 7:
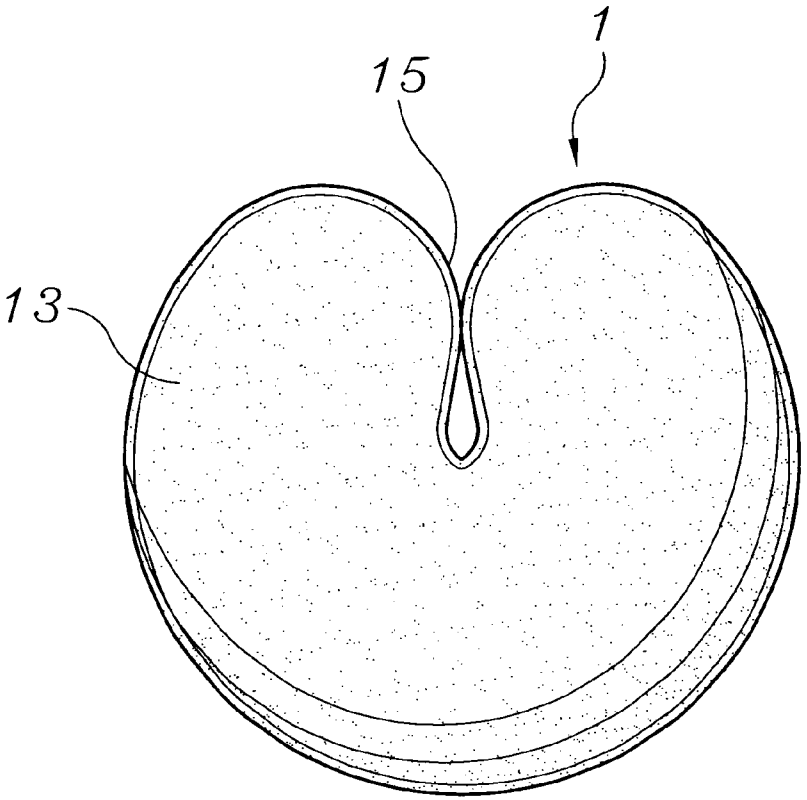
FIG. 7 is a front view of a falsie of the present invention when assembled.

The fluid-bag falsie 1 is sheet-like in shape when placed flat prior to its configuration into bent or rolled form. The concave arc edge portion 15, 14 can be bent so that the two opposite end portion points A and B are disposed adjacent one another, as shown in FIG. 3. When the falsie 1 is thus configured by bringing the two points A and B together, a three-dimensional bust form is realized, as shown in FIGS. 6 to 8. The improved falsie structure of the present invention is thus formed.

Figure 9:
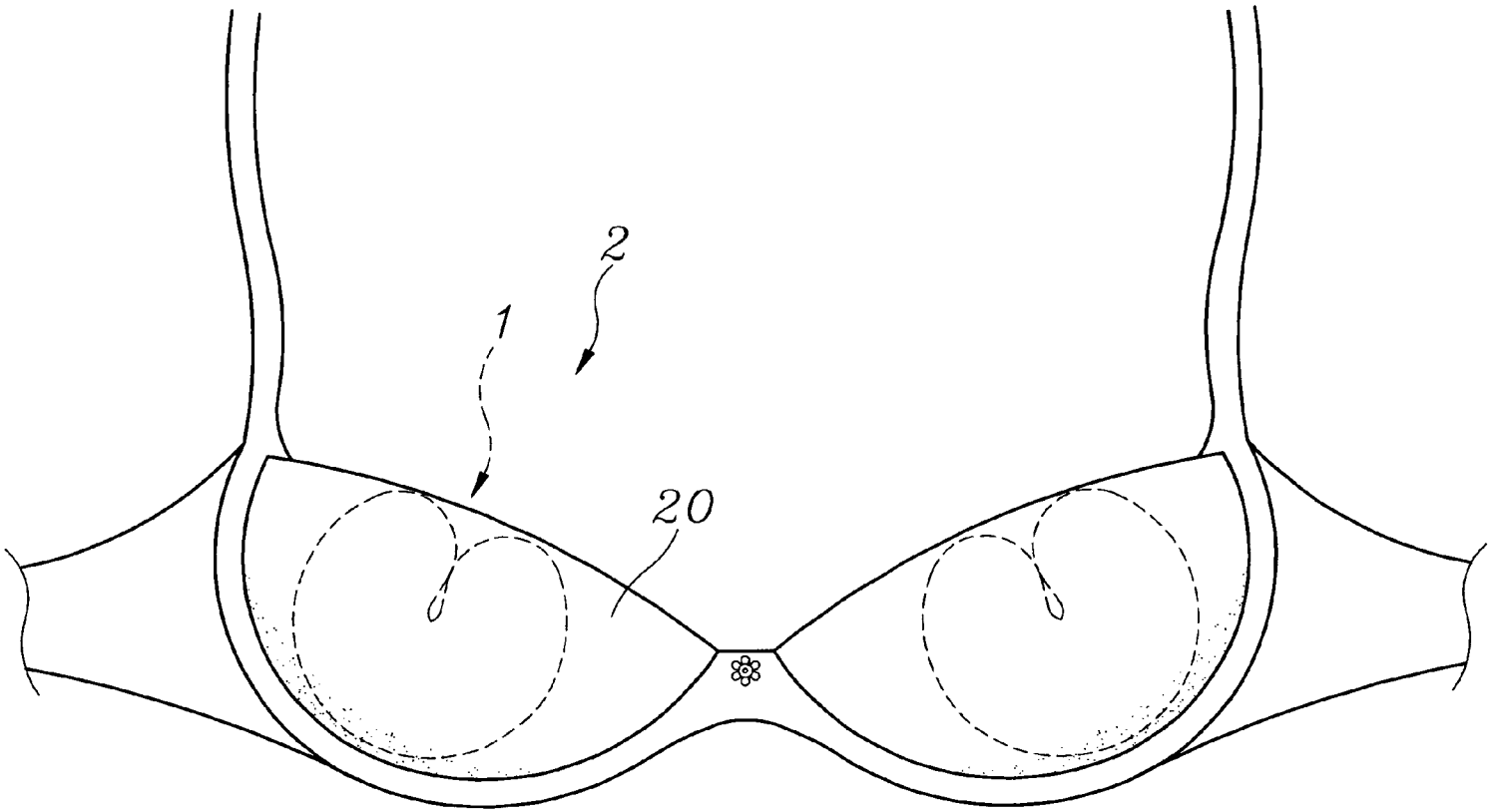
FIG. 9 is a front view of two falsies of the present invention when placed in two brassiere cups.
Figure 10:
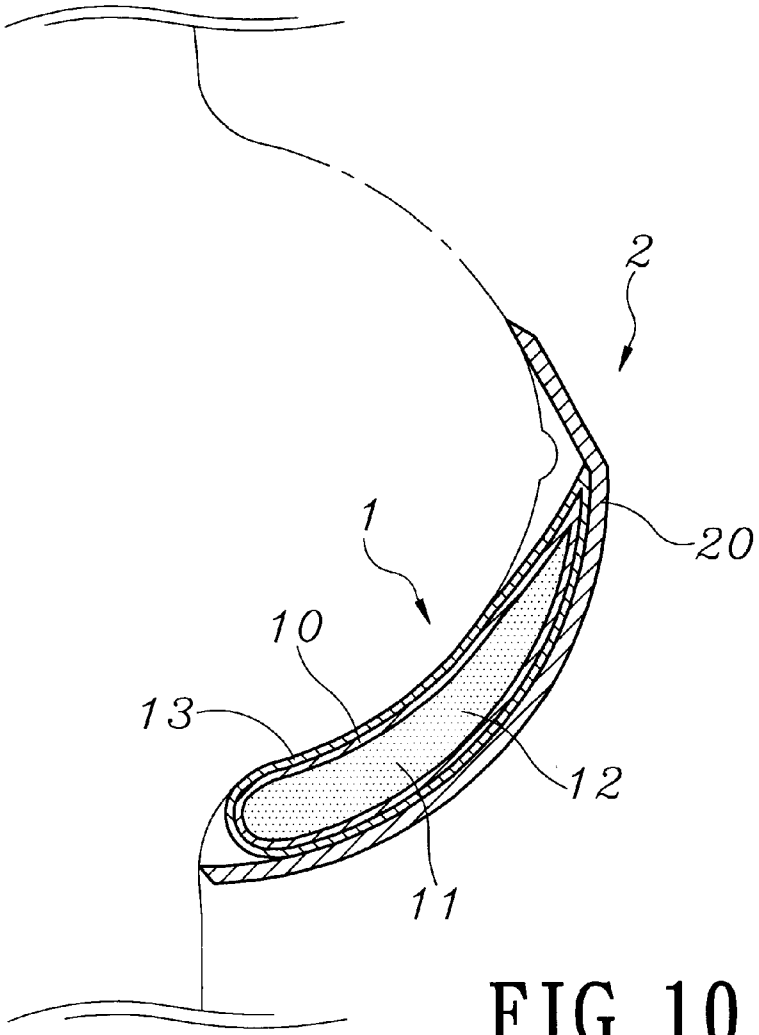
FIG. 10 is a cross-sectional view of a falsie of the present invention when placed in a brassiere cup.
Figure 11:
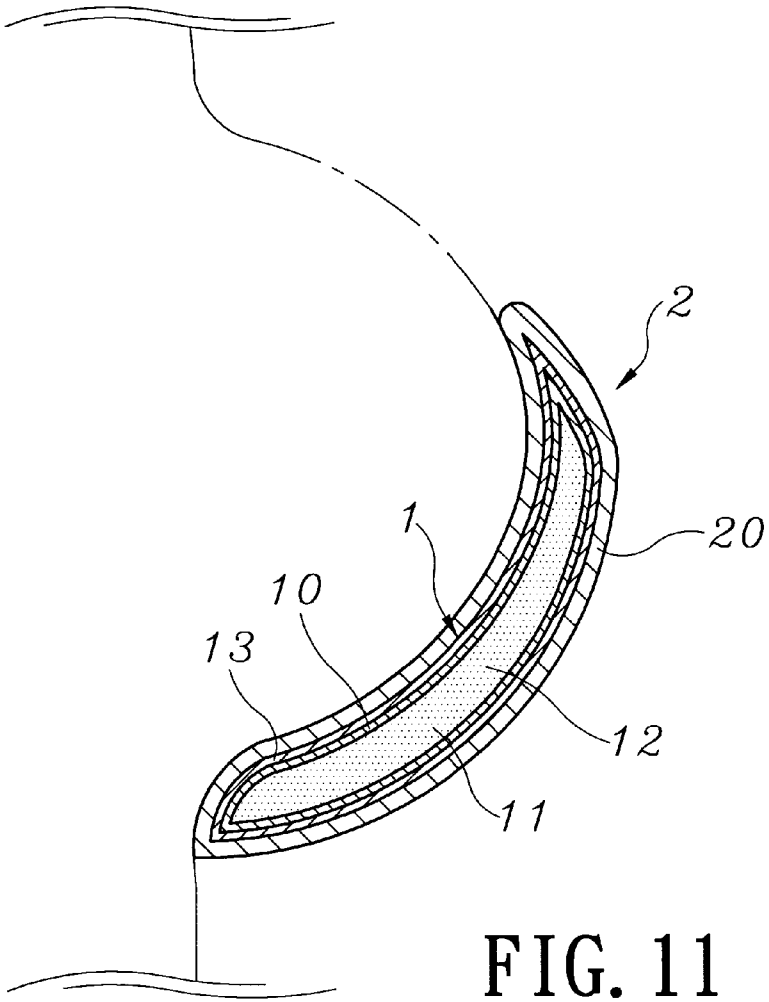
FIG. 11 is a cross-sectional view of a falsie of the present invention when sheathed in a brassiere cup.

As shown in FIGS. 9 and 10, a falsie 1 of the present invention can be placed inside a cup 20 of a brassiere 2 (or a swimsuit or a gym suit). With the help of the falsie structure, the effects of light weight and mobile, yet real feeling bust enhancement can be realized. As shown in FIG. 11, a falsie 1 of the present invention can also be sheathed inside a cup 20 of a brassiere 2 (or a swimsuit or a gym suit).

A falsie 1 of the present invention can be deflected to form a three-dimensional bust form due largely to its structural design. The intermediate portions of the falsie can form a protruding structure that conforms to the three-dimensional cup of the brassiere and thereby exhibit the natural, life-like curvature of a breast.

Moreover, the container 10 made of waterproof and flexible material with the hollow microspheres 11 and the fluid 12 filled therein is joined with the cloth layer 13 so that its firmness is enhanced. Hence, the fluid-bag falsie will not easily deform. The drawback that the enhanced appearance of the breasts cannot be maintained for a long time when the fluid-bag falsie is directly placed in a brassiere is thus overcome. Moreover, discomfort and uneven feel resulting from nonuniform pressure on the breasts by known solid falsies is improved upon.

Although the present invention has been described with reference to the preferred embodiments, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

I claim:

1. A falsie apparatus for insert within a cup of a brassiere comprising:

(a) a container formed of a waterproof and flexible material, said container having arcuately contoured end portions and an intermediate concave arc edge portion extending therebetween, said container being configured with said end portions disposed one adjacent the other, said container enclosing a fluid and a plurality of hollow microsphere members immersed therein; and, (b) a cloth layer joined to an outer surface of said container.

2. The falsie apparatus as recited in claim 1 wherein said container is formed of a plastic film material.

3. The falsie apparatus as recited in claim 1 wherein said microsphere members are each formed with a density measure of approximately 0.035 and a diameter within the approximate range of 100–150 microns.

4. The falsie apparatus as recited in claim 1 wherein said fluid is selected from the group consisting of: oil and water.

5. The falsie apparatus as recited in claim 1 wherein said cloth layer includes a petrochemical cloth material.

6. The falsie apparatus as recited in claim 1 wherein said cloth layer includes a material selected from the group consisting of: cotton and hemp cloth.

7. The falsie apparatus as recited in claim 1 wherein said cloth layer is adhesively joined to said outer surface of said container.

8. The falsie apparatus as recited in claim 1 wherein said cloth layer is heat-melt joined to said outer surface of said container.

9. The falsie apparatus as recited in claim 1 wherein said cloth layer is sewn to said outer surface of said container.

10. A. The falsie apparatus as recited in claim 1 comprising a pair of said cloth layers joined respectively to opposing portions of said outer surface of said container.

11. A falsie apparatus for insert within a cup of a brassiere comprising:

(a) a container formed of a waterproof and flexible material, said container having arcuately contoured end portions and an intermediate concave arc edge portion extending therebetween, said container being configured with said end portions disposed one adjacent the other, said container enclosing a fluid and a plurality of substantially solid microsphere members immersed therein; and, (b) a pair of cloth layers respectively lining a pair of opposed outer surfaces of said container.

* * * * *